US007758377B2

(12) United States Patent
Maruyama

(10) Patent No.: US 7,758,377 B2
(45) Date of Patent: Jul. 20, 2010

(54) COAXIAL CONNECTOR

(75) Inventor: Yuichi Maruyama, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/620,612

(22) Filed: Nov. 18, 2009

(65) Prior Publication Data

US 2010/0062641 A1 Mar. 11, 2010

Related U.S. Application Data

(63) Continuation of application No. PCT/JP2008/055226, filed on Mar. 21, 2008.

(30) Foreign Application Priority Data

Jun. 1, 2007 (JP) ..... 2007-146980

(51) Int. Cl.
*H01R 9/05* (2006.01)

(52) U.S. Cl. ..... 439/582; 439/585; 439/944

(58) Field of Classification Search ..... 439/854, 439/855, 578–582, 585, 944
See application file for complete search history.

(56) References Cited

U.S. PATENT DOCUMENTS 6,837,743 B2 * 1/2005 Ko ..... 439/582
7,186,142 B2 * 3/2007 Nagata et al. ..... 439/582
7,270,569 B2 * 9/2007 Petersen et al. ..... 439/582
7,367,811 B2 * 5/2008 Nagata ..... 439/63
2005/0026498 A1 2/2005 Ikeda et al.
2005/0239328 A1 10/2005 Nagata et al.
2008/0096420 A1 * 4/2008 Zeng ..... 439/582

FOREIGN PATENT DOCUMENTS

JP 2005-050720 A 2/2005
JP 2005-310515 A 11/2005
WO 2006/087953 A1 8/2006

OTHER PUBLICATIONS

Official Communication issued in International Patent Application No. PCT/JP2008/055226 mailed on Apr. 15, 2008.

* cited by examiner

*Primary Examiner*—James Harvey
(74) *Attorney, Agent, or Firm*—Keating & Bennett, LLP

(57) ABSTRACT

A coaxial connector having locking projections is provided which can be press-fittingly attached to and detached from a groove of a receptacle plural times with a smaller load and has a longer life without increasing the height of the coaxial connector. A tubular portion of a housing is rounded and has a gap formed by opposite ends of the tubular portion. A first locking projection is formed at a position diametrically opposite to the gap and a second locking projection and a third locking projection are located at positions that are spaced away from the first locking projection by about 90° or more in a circumferential direction. A circumferential length of each projection is set to be smaller than a circumferential length of an interval between the first locking projection and the second or third locking projection.

5 Claims, 6 Drawing Sheets

COAXIAL CONNECTOR

BACKGROUND OF THE INVENTION

1. Field of the Invention

The present invention relates to a coaxial connector for connecting a coaxial cable to a receptacle.

2. Description of the Related Art

The use of very small and thin communication equipment has recently become more prevalent. Correspondingly, electronic components used in such equipment have very small sizes and low heights. Coaxial connectors are also required to have smaller sizes and lower heights. Known coaxial connectors of this type are described in, e.g., Japanese Unexamined Patent Application Publication No. 2005-50720 and International Application WO2006/087953.

The coaxial connector described in Japanese Unexamined Patent Application Publication No. 2005-50720 includes, as illustrated in FIG. 11, a housing 130 connected to an outer conductor 101 of a coaxial cable 100 and having a tubular portion 131 which is capable of being press-fitted and locked into a groove 122 formed in an outer conductor 121 of a receptacle 120, a socket 135 connected to a center conductor 102 of the coaxial cable 100 and connected to a center conductor 123 of the receptacle 120, and an insulating bushing 136 fitted over the tubular portion 131 of the housing 130 and holding the socket 135.

In the coaxial connector of FIG. 11, as schematically illustrated in FIG. 12, the tubular portion 131 of the housing 130 has a substantially C-shape with a gap 131*a* left at one side and has a lock portion 132 formed along an entire circumference of the tubular portion 131 so as to project into the groove 122 which is formed in the outer conductor 121 of the receptacle 120. When the tubular portion 131 is attached to and detached from the outer conductor 121, the lock portion 132 constitutes a cantilevered beam while a portion C diametrically opposite to the gap 131*a* serves as a fulcrum. Therefore, any point of the beam over an entire beam length L acts as a point of effort (as indicated by hatching).

Considering the cantilevered beam from the viewpoint of dynamics, a larger force is required to generate a certain displacement of the beam as the point of effort approaches the fulcrum C. Accordingly, a load required to press-fit the tubular portion 131 at a point near the fulcrum C is increased to such an extent that the load tends to exceed a spring elastic limit displacement. This may result in a risk that the lock portion 132 and/or the groove 122 is plastically deformed and the coaxial connector can no longer be used even after attaching and detaching the coaxial connector once. In particular, because the height of the tubular portion 131 is reduced due to the above-described recent tendency toward the lower height of the coaxial connector, it is more difficult to ensure sufficient spring elasticity of the tubular portion 131.

SUMMARY OF THE INVENTION

Preferred embodiments of the present invention provide a coaxial connector which can be attached to and detached from a receptacle many times with a smaller load and has a longer life, without increasing the height of the coaxial connector.

According to a preferred embodiment of the present invention, a coaxial connector for connecting a coaxial cable having a center conductor and an outer conductor to a receptacle having a center conductor and an outer conductor, the coaxial connector including a housing connected to the outer conductor of the coaxial cable and having a tubular portion arranged to be press-fitted and locked into a groove provided in the outer conductor of the receptacle, a socket connected to the center conductor of the coaxial cable and arranged to be connected to the center conductor of the receptacle, and an insulating bushing mounted into the tubular portion of the housing and holding the socket, wherein the tubular portion has a substantially C-shape extending perpendicularly or substantially perpendicularly to a direction in which the tubular portion is press-fitted to the outer conductor of the receptacle, and has a gap extending parallel or substantially parallel to the press-fitting direction, and the tubular portion has three first, second and third locking projections to be press-fitted and locked into the groove provided in the outer conductor of the receptacle to extend perpendicularly or substantially perpendicularly to the press-fitting direction, the first locking projection being located at a position on a circumference of the tubular portion diametrically opposite to the gap, the second locking projection and the third locking projection being located at positions that are spaced away from the first locking projection by about 90° or more in a circumferential direction, and a circumferential length of each of the first, second and third locking projections is smaller than a circumferential interval between the first locking projection and the second or third locking projection.

In the coaxial connector, when the tubular portion of the housing is locked to the outer conductor of the receptacle, the first locking projection is arranged to act as a fulcrum and each of the second and third locking projections having a predetermined beam length with respect to the fulcrum are arranged to act as a point of effort instead of the entire circumference of the tubular portion being press-fitted into the groove of the receptacle. Such an arrangement eliminates the necessity of applying a strong load. As a result, the locking projections of the tubular portion are prevented from displacing beyond the spring elastic limit displacement when the coaxial connector is attached and detached. Further, the coaxial connector can be attached and detached many times without problems.

According to a preferred embodiment of the present invention, the coaxial connector can be attached to and detached from the receptacle without requiring such a large load, and can sufficiently endure a very large number of attaching and detaching operations. Further, since the tubular portion of the housing is not required to have a large size in the press-fitting direction, the demand for a lower height of the coaxial connector is not impeded.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

A coaxial connector according to preferred embodiments of the present invention will be described below with reference to the accompanying drawings.

Figure 1:
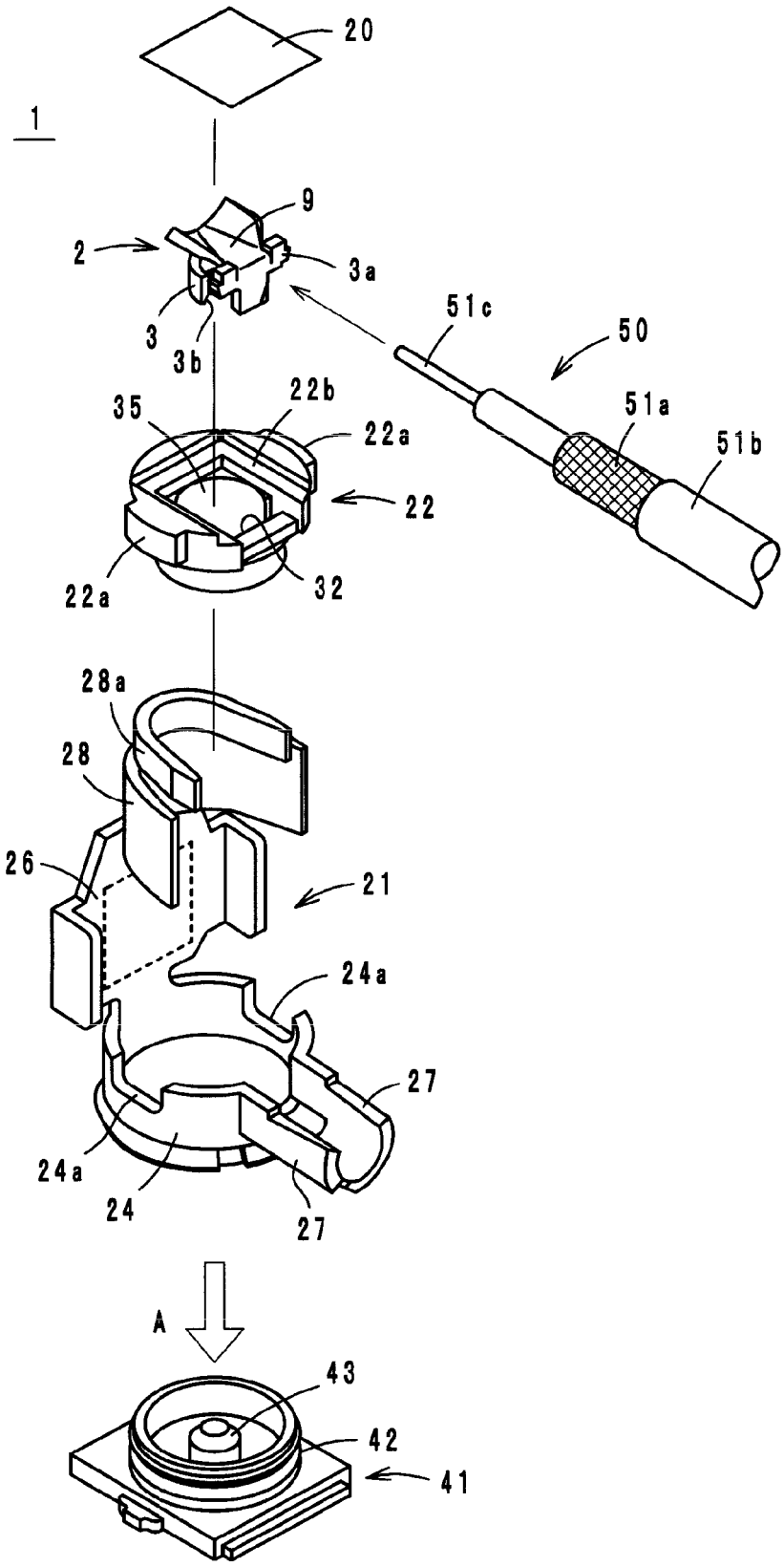
FIG. 1 is an exploded perspective view of a coaxial connector according to a preferred embodiment of the present invention.

A coaxial connector 1 is adapted for electrically connecting a coaxial cable 50 to a receptacle 41. As illustrated in FIG. 1, the coaxial connector 1 includes a housing 21 made of a metallic material having spring elasticity, a bushing 22 mounted into the housing 21 and made of an insulating resin material, a socket 2 held in the bushing 22 and made of a metallic material having spring elasticity, and an insulating sheet 20.

The housing 21 includes a tubular portion 24 arranged to be press-fitted and locked to an outer conductor 42 of the receptacle 41, a lid portion 26 covering an upper opening of the tubular portion 24, a pair of cover portions 27 each having a circular-arc shape and extending from the tubular portion 24 so as to cover an outer conductor 51*a* of the coaxial cable 50 from both sides, and a crimped portion 28 extending from the lid portion 26 and capable of being crimped to fit over the pair of cover portions 27, thus grasping the coaxial cable 50 from above the cover portions 27. A portion of the crimped portion 28 serves as a claw portion 28*a* that is to be crimped to fit over an outer skin 51*b* of the coaxial cable 50. The bushing 22 is inserted into the tubular portion 24 of the housing 21 through the upper opening of the tubular portion 24 and is fixedly held therein.

Further, the tubular portion 24 of the housing 21 has a gap 29 and locking projections 25*a*, 25*b* and 25*c*, which will be described in detail later.

The bushing 22 has a tapered shape such that an outer diameter at a fore end thereof as viewed in the direction of insertion into the tubular portion 24 of the housing 21 (i.e., an outer diameter of a lower portion) is smaller than that of an upper portion. Two lugs 22*a* are projected from the upper portion of the bushing 22 in the radial direction opposite to each other. Those two lugs 22*a* are fitted to cutouts 24*a* formed in the tubular portion 24 at the upper opening side thereof. With that arrangement, the bushing 22 is properly positioned with respect to the housing 21.

Further, the bushing 22 preferably has a rectangular or substantially rectangular fitting recess 32 into which a support portion 3*a* of a spring or elastic contact portion 3 of the socket 2 is fitted, and an elastic-contact-portion accepting hole 35 penetrating the bushing 22 in the axial direction and accepting the elastic contact portion 3 of the socket 2. The elastic-contact-portion accepting hole 35 has a space sufficient to accept the elastic contact portion 3 of the socket 2 even in the state where the elastic contact portion 3 is displaced outward in the radial direction upon press-fitting of a center conductor 43 of the receptacle 41 to the elastic contact portion 3.

The socket 2 includes the elastic contact portion 3 and a connecting portion 9 that is to be connected to a center conductor 51*c* of the coaxial cable 50. The elastic contact portion 3 is formed preferably by rounding a leaf spring (made of phosphor bronze), which has a constant width and a thickness of about 0.1 mm, into a substantially C-curved shape in a cross-section. Upon the press-fitting of the center conductor 43 of the receptacle 41, the elastic contact portion 3 of the socket 2 is displaced outward in the radial direction while holding pressure contact with an outer peripheral surface of the center conductor 43 at predetermined locations. An inner diameter of the elastic contact portion 3 preferably is set to be smaller than an outer diameter of the central conductor 43 within the range not exceeding a spring elastic limit. A lower end 3*b* of the elastic contact portion 3 is chamfered such that the central conductor 43 can be easily inserted.

The elastic contact portion 3 has the support portion 3*a* on the upper side thereof. The support portion 3*a* preferably has substantially the same size as that of the fitting recess 32 of the bushing 22 and is integrally extended from the elastic contact portion 3. The connecting portion 9 for electrical connection with the central conductor 51*c* of the coaxial cable is integrally extended from the support portion 3*a*. The connecting portion 9 is folded to extend perpendicularly or substantially perpendicularly to the axial direction of the elastic contact portion 3.

Figure 3:
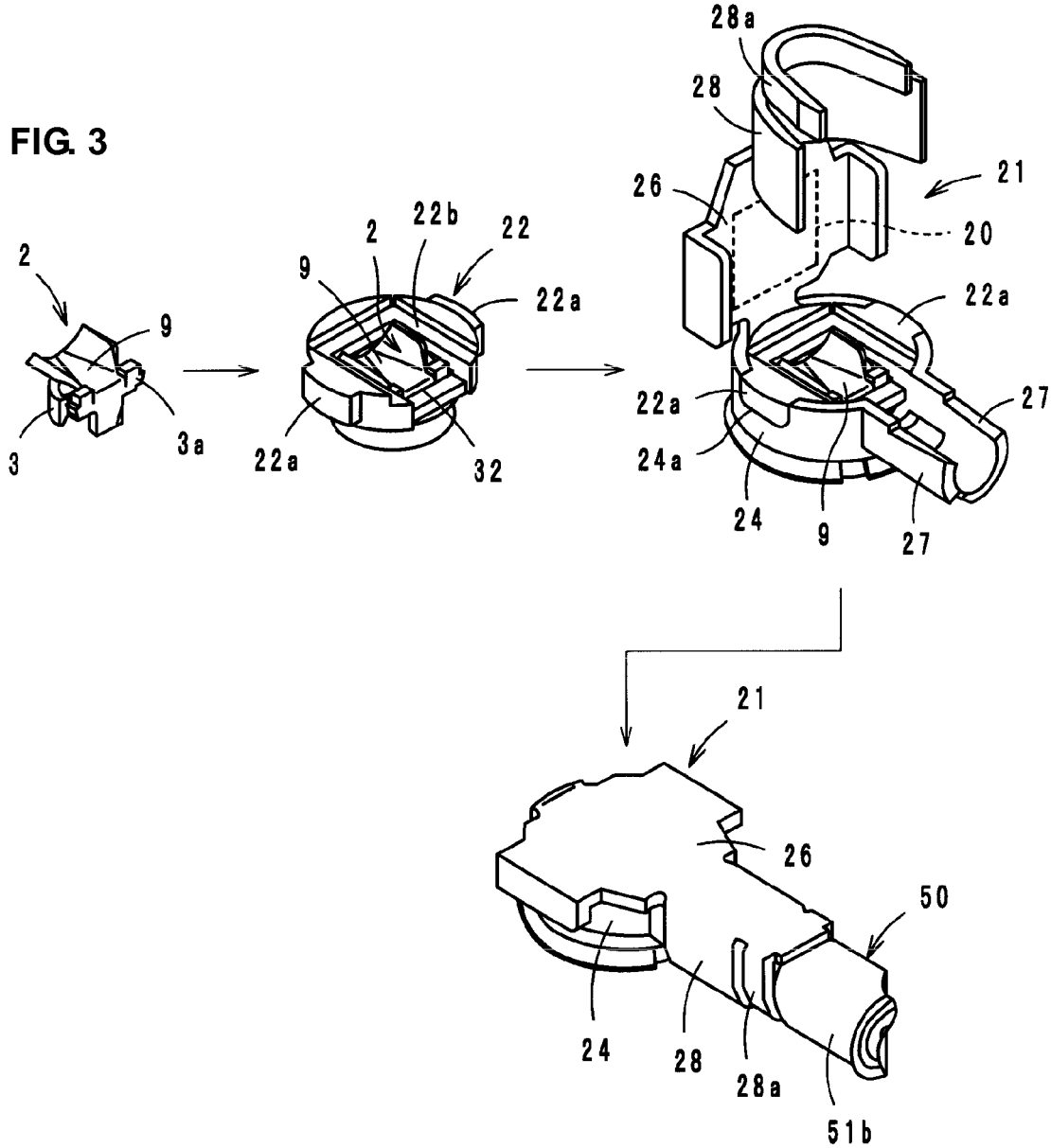
FIG. 3 is a perspective view illustrating assembly procedures of the coaxial connector illustrated in FIG. 1.

As illustrated in FIG. 3, the socket 2 is assembled with the bushing 22 such that the support portion 3*a* of the elastic contact portion 3 is fitted into the fitting recess 32 of the bushing 22 and the elastic contact portion 3 is accepted in the elastic-contact-portion accepting hole 35. Then, the bushing 22 is accepted in the tubular portion 24 of the housing 21. A fore end portion of the central conductor 51*c* of the coaxial cable 50, which has been machined to be adapted for termination, is arranged on the connecting portion 9 of the socket 2, and the central conductor 51*c* and the connecting portion 9 are soldered together. As a result, the socket 2 is electrically connected to the central conductor 51*c* of the coaxial cable 50.

The insulating sheet 20 having been cut into a predetermined shape is arranged in a recess 22*b* formed in an upper surface of the bushing 22. In that state, the lid portion 26 of the housing 21 is folded so as to cover the upper surface of the bushing 22.

Figure 4:
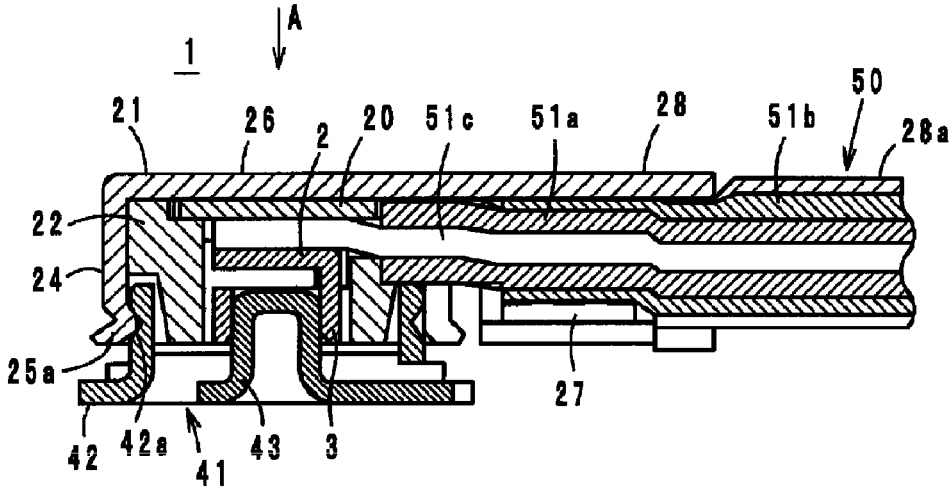
FIG. 4 is a sectional view of the coaxial connector taken along the longitudinal direction, the view illustrating the state where the coaxial connector is fitted to a receptacle.
Figure 5:
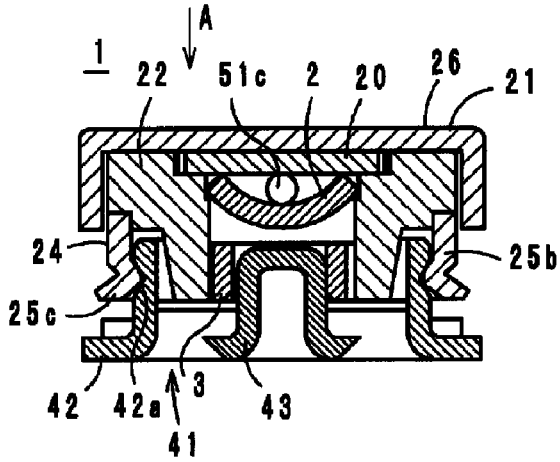
FIG. 5 is a sectional view of the coaxial connector taken along the transverse direction, the view illustrating the state where the coaxial connector is fitted to the receptacle.

Thus, as illustrated in FIGS. 4 and 5, the insulating sheet 20 insulates the cover portion 26 of the housing 21 from a connecting section in which the socket 2 and the central conductor 51*c* of the coaxial cable 50 are connected to each other. Because the insulating sheet 20 can be formed of a thin sheet, the presence of the insulating sheet 20 does not impede a reduction in the height of the coaxial connector 1. As an alternative, in assembly, the insulating sheet 20 may be previously pasted to the backside of the cover portion 26 of the housing 21 (as indicated by a dotted line in FIG. 3).

Next, the crimped portion 28 of the housing 21 is crimped to fit over the pair of cover portions 27, thus grasping the coaxial cable 50 from above the cover portions 27. Further, the claw portion 28*a* is crimped to fit over the outer skin 51*b* of the coaxial cable 50.

Figure 2:
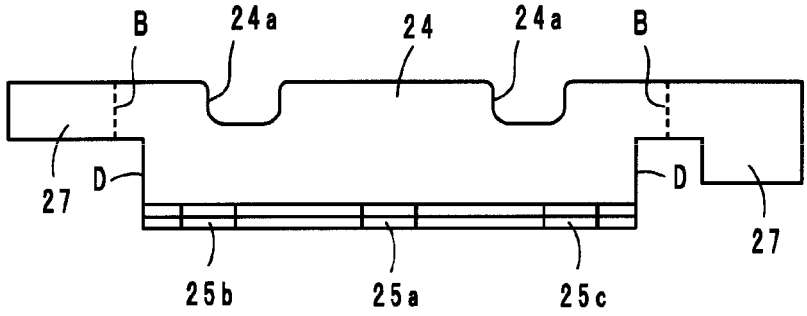
FIG. 2 is a developed view of a tubular portion of a housing.
Figure 6:
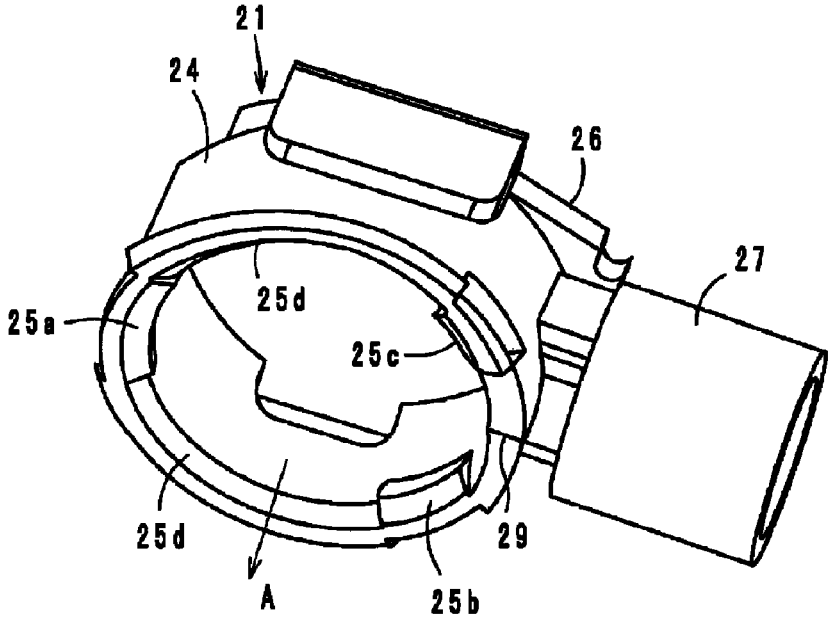
FIG. 6 is a perspective view of the housing when viewed from below.

FIG. 6 is a perspective view of the housing when viewed from below, and FIG. 2 is a developed view of the tubular portion 24. Note that the cover portion 26 and the crimped portion 28 are omitted in FIG. 2 for simplification of the drawing.

The tubular portion 24 is preferably shaped, illustrated in FIG. 6, by rounding the tubular portion 24 in the developed form, illustrated in FIG. 2, into a substantially C-shape and by folding the cover portions 27 along dotted lines B. With the tubular portion 24 rounded into the substantially C-shape, opposite ends D of the tubular portion 24 are positioned close to each other such that the gap 29 is formed to extend parallel to a press-fitting direction A (see FIG. 6).

Figure 7A:
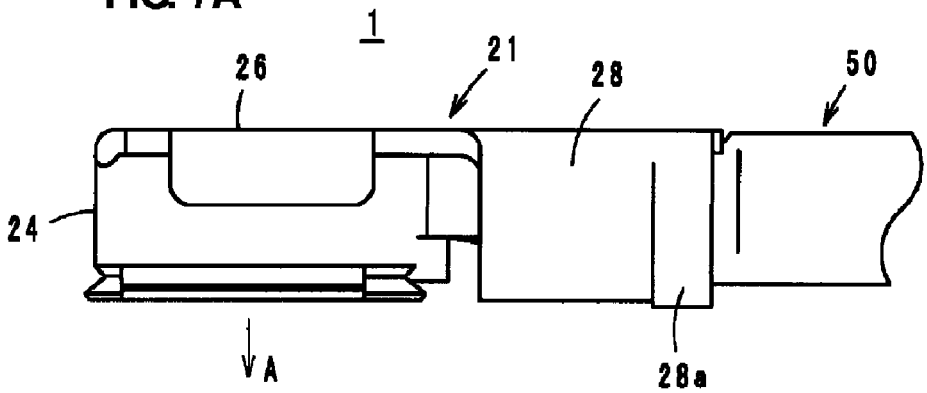
FIG. 7A is a side view of the coaxial connector.
Figure 7B:
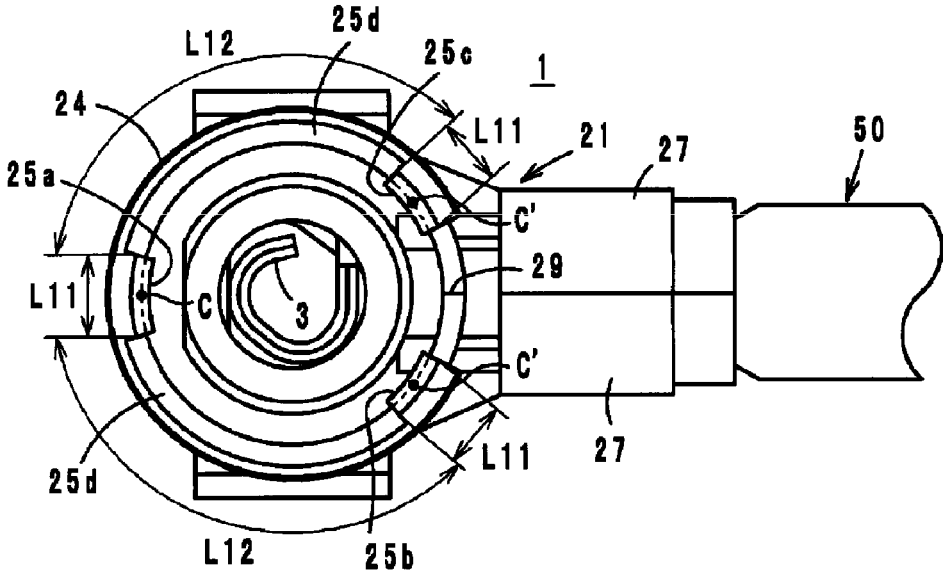
FIG. 7B is a bottom view of the coaxial connector.

A lower inner peripheral portion of the tubular portion 24 is locked into a groove 42*a* (see FIG. 5), which is formed in an outer peripheral portion of the outer conductor 42 of the receptacle 41, upon press-fitting of the coaxial connector 1 into the receptacle 41 in the direction of arrow A. To realize the locking, first, second and third locking projections 25*a*, 25*b* and 25*c* are formed in a lower inner peripheral surface of the tubular portion 24 by pressing such that those projections slightly project inward of the tubular portion 24. As illustrated in FIG. 7B, the first locking projection 25*a* is located at a position on the circumference of the tubular portion 24 diametrically opposite to the gap 29, and the second and third locking projections 25*b* and 25*c* are located at positions that are spaced away from the first locking projection 25*a* by about 90° or more in the circumferential direction. A circumferential length L11 of each of the projections 25*a*, 25*b* and 25*c* preferably is set to be smaller than a circumferential interval L12 between the projections. The circumferential length L11 of each projection is preferably about ⅕ or less, for example, of the entire circumference of the tubular portion 24.

Figure 8A:
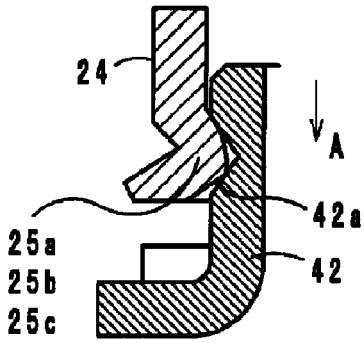
FIG. 8A is a sectional view illustrating the state where a projection on the tubular portion of the housing is locked into a groove provided in an outer conductor of the receptacle.
Figure 8B:
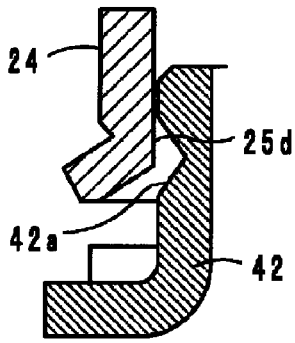
FIG. 8B is a sectional view illustrating the relationship between a region of the tubular portion other than the projection and the groove.

Stated another way, when the housing 21 is fitted to the receptacle 41, the projections 25*a*, 25*b* and 25*c* of the tubular portion 24 are engaged and locked into the groove 42*a* of the outer conductor 42, as illustrated in FIG. 8A. On the other hand, a region 25*d* where the projections are not formed has no portions engaged in the groove 42*a*, as illustrated in FIG. 8B.

In this preferred embodiment, as illustrated in FIG. 7B, the first locking projection 25*a* acts as a fulcrum C, and each of the second and third locking projections 25*b* and 25*c* each having a predetermined beam length from the fulcrum C acts as a point C' of effort. According to the load theory of a cantilevered beam, a load acting on the point C' of effort is inversely proportional to the third power of the beam length. Therefore, loads acting on the projections 25*a*, 25*b* and 25*c* are significantly smaller than those when the second and third locking projections 25*b* and 25*c* are formed at positions within 90° with respect to the first locking projection 25*a*. As a result, the projections 25*a*, 25*b* and 25*c* are prevented from displacing beyond the spring elastic limit displacement when the coaxial connector is attached and detached. Thus, the coaxial connector can be attached and detached a great number of times without problems.

Note that the locking projections 25*a*, 25*b* and 25*c* are preferably formed, as described above, integrally with the tubular portion 24 in the state slightly projecting inward of the tubular portion 24 rather than the state separated from the tubular portion 24 through a slit or a groove.

Figure 9:
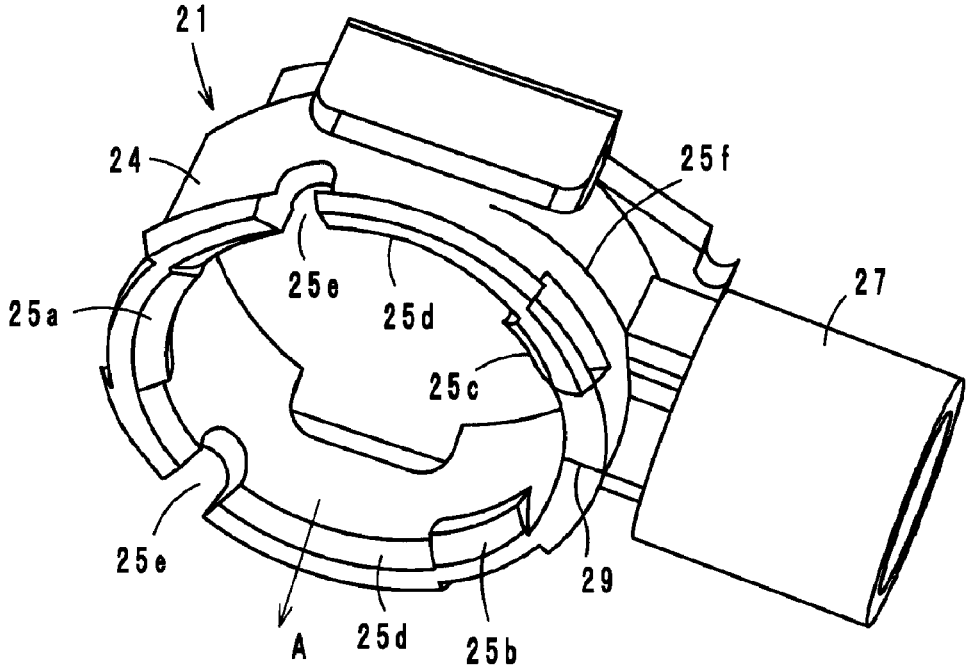
FIG. 9 is a perspective view illustrating a modification of the tubular portion of the housing.
Figure 10:
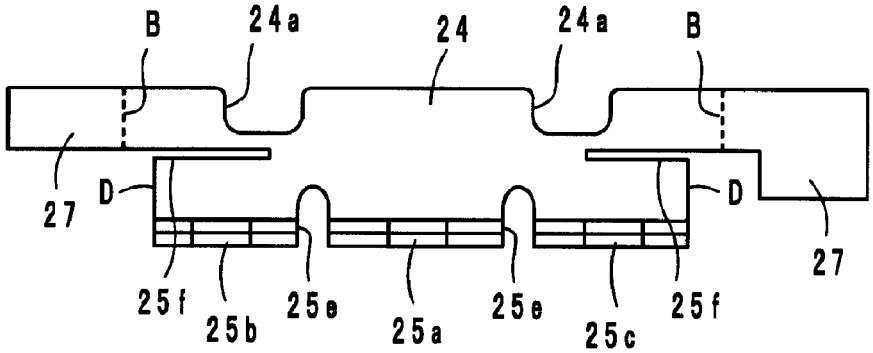
FIG. 10 is a developed view of the tubular portion according to the modification.
Figure 11:
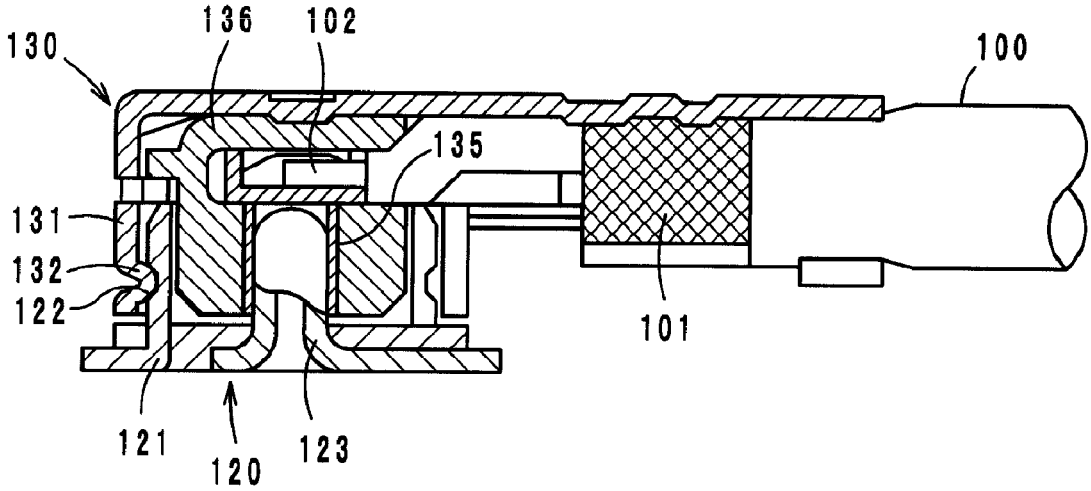
FIG. 11 PRIOR ART
FIG. 11 is a sectional view of a known coaxial connector.
Figure 12:
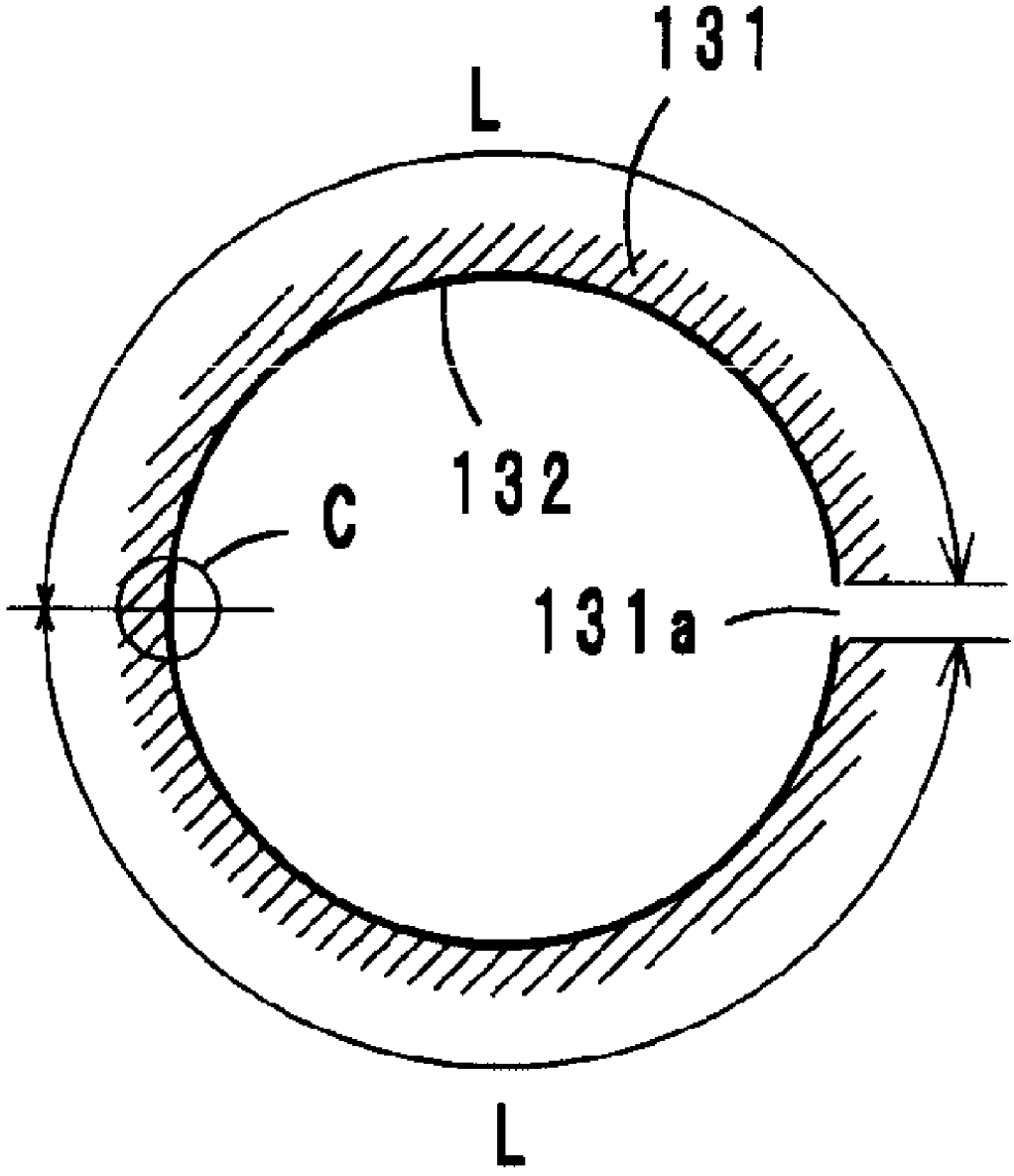
FIG. 12 PRIOR ART
FIG. 12 is an explanatory view illustrating the state where a tubular portion of the known coaxial connector operates as a cantilevered beam.

FIGS. 9 and 10 illustrate a modification of the tubular portion 24 of the housing 21. In the modification of the tubular portion 24, vertical slits 25*e* are formed in a lower portion of the tubular portion 24 to extend from its lower end between the first and second locking projections 25*a* and 25*b* and between the first and third locking projections 25*a* and 25*c*, respectively. Further, horizontal slits 25*f* are formed in the tubular portion 24 to extend from opposite edges of the gap 29 perpendicularly or substantially perpendicularly to the press-fitting direction A.

By forming the vertical slits 25*e* and the horizontal slits 25*f*, the spring elasticity of the tubular portion 24 is increased. Therefore, the coaxial connector 1 is more easily attached to and detached from the receptacle 41, and the life of the coaxial connector 1 is further prolonged. As an alternative, only one of the vertical slits 25*e* or the horizontal slits 25*f* may be formed.

In the coaxial connector described above, the first locking projection is preferably located at a position on the circumference of the tubular portion diametrically opposite to the gap, and the second and third locking projections are preferably located at positions that are spaced away from the first locking projection by about 90° or more in the circumferential direction. When the tubular portion is locked to the outer conductor of the receptacle, the first locking projection acts as a fulcrum and each of the second and third locking projections having a predetermined beam length with respect to the fulcrum acts as a point of effort instead of the entire circumference of the tubular portion being press-fitted into the groove of the receptacle. Such an arrangement eliminates the necessity of applying such a strong load. As a result, the locking projections of the tubular portion are prevented from displacing beyond the spring elastic limit displacement when the coaxial connector is attached and detached. Further, the coaxial connector can be attached and detached a great number of times without problems.

In the coaxial connector according to various preferred embodiments of the present invention, the coaxial cable may be connected to the housing and the socket perpendicularly or substantially perpendicularly to the press-fitting direction (i.e., the right angle type), or may be connected parallel or substantially parallel to the press-fitting direction (i.e., the straight type).

The first, second and third locking projections may be each formed in the state of the tubular portion being projected inward. A vertical slit may be formed in a lower portion of the tubular portion to extend from its lower end between the first locking projection and each of the second and third locking projections. Further, a horizontal slit may be formed in the tubular portion to extend from the gap perpendicularly or substantially perpendicularly to the press-fitting direction. The presence of the vertical slit and the horizontal slit increases the spring elasticity of the tubular portion. As a result, the coaxial connector is more easily attached to and detached from the receptacle, and the life of the coaxial connector is further prolonged.

The coaxial connector according to the present invention is not limited to the above-described preferred embodiments and can be variously modified within the scope of the present invention.

For example, while the opposite edges of the gap formed in the tubular portion of the housing are preferably positioned close to each other in the above-described preferred embodiments, those edges may be positioned away from each other by a predetermined width.

As described above, the present invention is useful when practiced as a coaxial connector for connecting a coaxial cable to a receptacle. Particularly, the present invention is advantageous in that the coaxial connector can be attached to and detached from the receptacle plural times with a smaller load and has a longer life without increasing the height of the coaxial connector.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A coaxial connector for connecting a coaxial cable having a central conductor and an outer conductor to a receptacle having a central conductor and an outer conductor, the coaxial connector comprising:

a housing connected to the outer conductor of the coaxial cable and having a tubular portion arranged to be press-fitted and locked into a groove provided in the outer conductor of the receptacle;

a socket connected to the central conductor of the coaxial cable and arranged to be connected to the central conductor of the receptacle; and an insulating bushing mounted into the tubular portion of the housing and holding the socket; wherein the tubular portion has a substantially C-shape extending perpendicularly or substantially perpendicularly to a direction in which the tubular portion is press-fitted to the outer conductor of the receptacle, and has a gap extending parallel or substantially parallel to the press-fitting direction; and the tubular portion has three first, second and third locking projections to be press-fitted and locked into the groove provided in the outer conductor of the receptacle to extend perpendicularly or substantially perpendicularly to the press-fitting direction, the first locking projection being located at a position on a circumference of the tubular portion diametrically opposite to the gap, the second locking projection and the third locking projection being located at positions spaced away from the first locking projection by about 90° or more in a circumferential direction, and a circumferential length of each of the first, second and third locking projections is smaller than a circumferential length of an interval between the first locking projection and the second or third locking projection.

2. The coaxial connector according to claim 1, wherein the coaxial cable is connected to the housing and the socket perpendicularly or substantially perpendicularly to the direction in which the tubular portion is press-fitted to the outer conductor of the receptacle.

3. The coaxial connector according to claim 1, wherein the first, second and third locking projections are each arranged in a state of the tubular portion being projected inward.

4. The coaxial connector according to claim 1, wherein a vertical slit is arranged in a lower portion of the tubular portion to extend from a lower end thereof between the first locking projection and each of the second and third locking projections.

5. The coaxial connector according to claim 1, wherein a horizontal slit is arranged in the tubular portion to extend from the gap perpendicularly or substantially perpendicularly to the press-fitting direction.

* * * * *